United States Patent [19]

Minogue

[11] Patent Number: 4,947,147

[45] Date of Patent: Aug. 7, 1990

[54] HIGH VOLTAGE TRIP MECHANISM FOR SIGN SEGMENTS

[76] Inventor: Robert W. Minogue, 25200 Carlos Bee Blvd., #379, Hayward, Calif. 94542

[21] Appl. No.: 448,788

[22] Filed: Dec. 11, 1989

[51] Int. Cl.[5] ..... H01H 61/00; H01H 71/14

[52] U.S. Cl. ..... 337/18; 337/75; 337/108

[58] Field of Search ..... 337/17, 18, 19, 27, 337/28, 32, 108, 75, 97; 313/151

[56] References Cited

U.S. PATENT DOCUMENTS

| | | | |
|---|---|---|---|
| 2,474,600 | 6/1949 | Stender et al. | 337/19 |
| 2,479,179 | 8/1949 | Newbill | 337/18 |
| 2,574,278 | 11/1951 | Morgan | 337/18 |

*Primary Examiner*—H. Broome

*Attorney, Agent, or Firm*—Townsend and Townsend

[57] ABSTRACT

According to one aspect of the invention, it comprises a fireproof enclosure having a first and a second electrical terminal. The first electrical terminal is coupled to an electrical contact internal the fireproof enclosure. An actuating member is provided in the trip mechanism. A first end is inside the mechanism, while a second end extends outside. The actuator member is biased to have the first end in contact to the electrical contact at a first position. The first end has a bimetallic latch coupled thereto. The bimetallic latch comprises a contact portion at the point of coupling to the first end and a first and second wing portion extending from the contact portion. Ledges are disposed on the interior of the trip mechanism. The wing portions engage the ledges to hold the actuator member at a second position. The second position establishes a gap between the electrical contact and the contact portion of the bimetallic latch. The gap has a preselected distance, which is dependent upon the operating voltage of the sign segments. The second electrical terminal is coupled to the contact portion of the bimetallic latch. The second end of the actuator member is operable to move the actuator member from the first position to the second position.

2 Claims, 1 Drawing Sheet

HIGH VOLTAGE TRIP MECHANISM FOR SIGN SEGMENTS

BACKGROUND OF THE INVENTION

The present invention relates generally to a high voltage trip mechanism which shunts an individual sign segment. More specifically, the high voltage switch utilizes a bimetallic latching mechanism which is locally heated upon application of an electric arc. The latch holds the sign segment continuously shunted until the switch is manually reset.

SUMMARY OF THE PRIOR ART

FIG. 1. illustrates an informational sign 10 in which it is notoriously well-known to provide electroluminescent devices 12, 14, such as a neon tube, in sign segments 16 shaped as letters or numbers. It is common to use translucent letters 18 overlying individual segments 16, highlighting the letter shape or adding definition, color, or other cosmetic attributes to the sign.

Devices 12, 14 are illuminated by operating a transformer 20 to cause an electric current to run through a gas contained within. Usually sign segments 16 are connected to one another via a serial electrical connection, depicted in schematic fashion by electrical path 24. Current flows through devices 12, 14 one after another, from a power terminal 26 to a ground terminal 28. These devices 12, 14 are operated at high voltages, typically in excess of 10,000 volts.

Electroluminescent devices 12, 14 sometimes fail. When a particular device fails, current no longer flows; an open circuit is present. As the devices 12, 14 are serially coupled, an electric open in one device 14 prevents current from flowing in any device 12, 14 via path 24. The entire sign 10 is extinguished.

Other difficulties are present. First, upon failure, the overlying translucent letters 18 make inspection and detection of failed device 14 difficult.

Second, the high voltage potential of the failed sign segment can attempt to establish an alternate path from terminal 30 to ground. This alternate path to ground may be through a mounting bolt, or other metal object. To establish this alternate ground path, electric arcing occurs which is dangerous and has the possibility of starting fires.

A prior art solution was to put a switch 40, 42 in parallel with each sign segment 16. Switch 40, 42 would shunt terminals 30, 32 of sign segment 16 when it failed. In shunting the terminals 30, 32, current is permitted to bypass failed segment 14, and thereby be available to operate the remaining devices 12 serially coupled to failed device 14.

Of the prior art solutions, at least two types of switches 40, 42 were developed. The first was the fusible contact, an example of which is disclosed in U.S. Pat. Nos. 2,479,179, and 2,474,600. These patents depict switches which would continuously short a sign segment 16 in response to a open condition. The short is designed to be relatively permanent, requiring replacement of the entire switch 40, or disconnection of switch 40 and repair.

The second prior art solution for switch 42, was the use of a bimetallic strip 44 inside a switch 42, as disclosed for example in U.S. Pat. No. 2,562,692. Switch 42 would become heated by an electric arc when segment 16 failed. The arcing would operate on the bimetallic strip 44, as is well known in the art, causing a contact 46 to be closed as bimetallic strip 44 bent. However, this standard use of bimetallic strips 44 would cause relatively continuous, though intermittent, arcing as described below. After contact 46 closed, which would stop the arcing, bimetallic strip 44 would be able to cool. Thereafter, bimetallic strip 44 would bend back towards its original position, and thereby open contact 46. If device 14 continued to malfunction, then arcing would recommence and once again heat bimetallic strip 44 until contact 46 closed, whereupon cooling would start again. This series of steps would continue until device 14 was repaired. This solution has the disadvantage that arcing, with its attendant fire hazard, would be continuously present.

Additionally, a source of electromagnetic interference is created by the continuous expansion and contraction of bimetallic strip 44 with its attendant intermittent arcing.

SUMMARY OF THE INVENTION

The present invention provides method and apparatus for positively shunting a failed sign segment until it is manually reset. This invention offers several advantages over the prior art. First, the arcing is controlled and occurs only in a fireproof enclosure for a limited duration. Second, the trip mechanism maintains the shunt of a sign segment until it is manually reset. Third, this maintained shunt is positive and exists without electromagnetic interference or prolonged arcing, thereby decreasing the fire risk.

According to one aspect of the invention, it comprises a fireproof enclosure having a first and a second electrical terminal. The first electrical terminal is coupled to an electrical contact internal the fireproof enclosure. An actuating member is provided in the trip mechanism. A first end is inside the mechanism, while a second end extends outside. The actuator member is biased to have the first end in electrical communication to the electrical contact at a first position toward the electrical contact. The first end has a bimetallic latch coupled thereto. The. bimetallic latch comprises a first portion proximate the first end adjacent the electrical contact and a second portion extending from the first portion contacting the interior of the enclosure. Ledges are defined on the interior of the trip mechanism. The second portion engages the ledge to hold the actuator member at a second position away from the electrical contact. The second position establishes a gap between the electrical contact and the first portion of the bimetallic latch. The gap has a preselected distance, which is dependent upon the operating voltage of the sign segments. The second electrical terminal is coupled to the first portion of the bimetallic latch. The second end of the actuator member is operable to move the actuator member from the first position to the second position.

In preparation for operation, the first terminal of the trip mechanism is coupled to a first terminal of a sign segment which is also coupled to the operating voltage. The second terminal of the trip mechanism is coupled to a second terminal of the sign segment which is also coupled to an electrical ground.

In operation, the trip mechanism is connected as described above to each of a plurality of sign segments. The actuator member is operated until it is latched in the second position. The sign is illuminated. When the sign is illuminated, a potential is established across each of the parallel combinations of the sign segment terminals and the mechanism. For properly operating sign segments, the resistance of the sign segment is less than that of the gap, and the voltage established across the sign segment terminals is less than that required to have an arc across the gap. It is generally on the order of 10,000 volts per inch at standard conditions to have an arc cross the gap. As long as each sign segment operates properly, the voltage across the parallel combination of the sign segment and the trip mechanism will be less than that necessary to cause arcing.

When a particular sign segment fails, an open circuit is created across the sign segment terminals. The entire sign is extinguished. Now, the voltage across the parallel combination of the sign segment and the trip mechanism will exceed that voltage necessary to cause arcing. Therefore, an arc is established inside the fireproof enclosure between the electric contact and the first portion of the bimetallic latch. The arcing locally heats the top of the bimetallic latch at the first portion. By well known principles, the heating of the first portion causes the second portion of latch to bend and release from the ledge. The release of the ledge allows the biased actuator member to return to the first position in which the first portion electrically communicates with the electrical contact.

Thereafter, the electrical terminals of the trip mechanism are effectively and positively closed, thus shunting the terminals of the failed sign segment. The current necessary to allow the remainder of the sign segments comprising the sign is permitted to flow by shunting through the trip mechanism, and the sign is illuminated. The trip mechanism remains in the first position until the actuator is manually operated to reestablish the gap.

The present invention affords superior results over the prior art because the arcing is controlled inside a fireproof enclosure, and the arcing is limited in duration to a single period of time necessary to heat the bimetallic latch and permit the latch to release from the ledge. Additionally, the trip mechanism establishes and maintains the shunt until it is manually reset. Further, the shunt is positive and continuous, thereby avoiding electromagnetic interference and minimizing additional fire hazards by avoiding prolonged or intermittent arcing.

A further understanding of the nature and advantages of the invention may be realized by reference to the remaining portions of the specification and attached drawings.

DESCRIPTION OF THE PREFERRED EMBODIMENT

Figure 1:
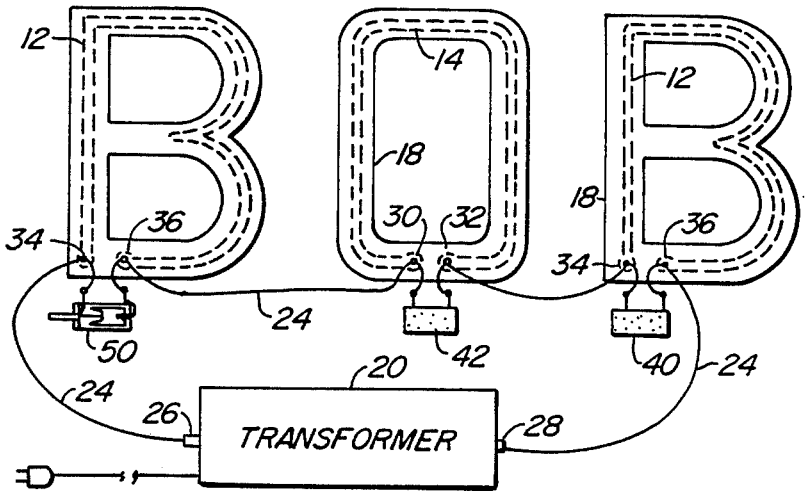
FIG. 1 is a schematic representation of a sign comprised of a series of electroluminescent devices having shorting switches coupled in parallel.
Figure 2:
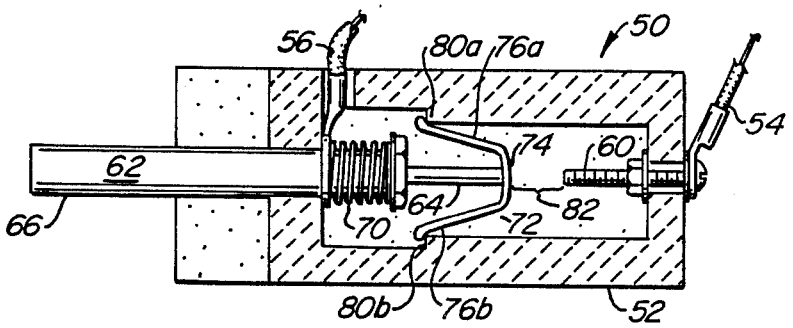
FIG. 2 is a perspective view of a trip mechanism embodying the present invention showing the relevant components, the trip mechanism is shown in the second position.

FIG. 2 is a perspective view of a trip mechanism 50 according to the present invention. Mechanism 50 is used in sign 10 of FIG. 1 as a replacement for switches 40, 42.

Mechanism 50 comprises a fireproof enclosure 52 through which a first electrical terminal 54 and a second electrical terminal 56 pass. First terminal 54 has an internal extension forming an electrical contact 60.

Figure 3:
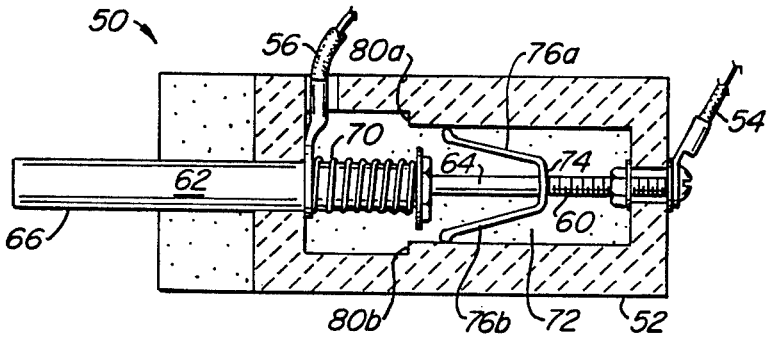
FIG. 3 is a perspective view similar to that of FIG. 2 except the trip mechanism is viewed in the first position.

An actuator member 62 having a first end 64 interior of enclosure 52 and a second end 66 exterior enclosure 52. Member 62 has a spring 70 which normally biases member 62 in a closed first position, as shown in FIG. 3. At first end 64, a bimetallic latching element 72 is attached. Latching element 72 has a first portion 74 and second portions **76*a*, 76*b*. Spring 70 also serves to electrically couple second terminal 56 to latch element 72**.

FIG. 3 is a perspective view of trip mechanism 50 in its first position. First and second ledges **80*a*, 80*b* are provided to engage second portions 76*a*, 76*b*, respectively, as shown in FIG. 2, and hold actuator member 62 in the second position. When member 62 is held in the second position, a gap 82 is established between contact 60 and first portion 74. Gap 82 is selected based upon the operating voltage of a device 14 to which mechanism 50 is ultimately coupled to. Second end 66 may be operated to move member 62 from the first position of FIG. 2 to the second position of FIG. 3**.

By reference to FIGS. 1 and 3, the preparation of mechanism 50 for operation may be described. Terminal 54 is coupled to terminal 32, and terminal 56 is coupled to terminal 36 of device 14. In similar fashion, mechanisms 50 may be coupled to devices 12 by coupling terminals 54 and 56 to terminals 34 and 36 respectively. Second end 66 is operated to move member 62 to the second position.

In operation, the parallel combination of device 12 and mechanism 50 have a potential drop of approximately 1,000 volts. As gap 82 has been preselected to permit arcing at a voltage drop of 2,000 volts, no arcing will occur in mechanism 50 if it is connected in parallel to an operating device 12. However, upon coupling of mechanism 50 to failed device 14, 7,500–15,000 volts is established across the parallel combination because failed device 14 operates as an electrical open. With this large potential, arcing occurs across gap 82 inside enclosure 52. Arcing continues as long as the sufficient potential is present across terminals 56 and 54. The reader will of course understand that these operating voltages will vary, in understood relation, as various parameters of the system change. These parameters include: operating voltage, number of sign elements, type of gas, and size of sign.

When arcing occurs, a very hot spark is established from contact 60 to first portion 74. This very hot spark locally heats first portion 74 causing second portions **76*a* and 76*b* to bend and release from ledges 80*a* and 80*b*. When second portions 76*a*, 76*b* are released, member 62 is driven by spring 70 to the first position so that contact 60 is placed in electrical communication with first portion 74. In the first position, a short is established across terminals 54 and 56, thereby shunting terminals 30 and 32 and reestablishing path 24 through mechanism 50. Thus, operating devices 12 will illuminate. This means that a repair technician could readily determine that device 14 had failed, even with translucent letters 16 superimposed over the device 14, and irrespective of the number of devices 12, 14 present in sign 10**.

The reader may quickly grasp the significance of the present invention when a Las Vegas type "spectacular" sign is described which may have thousands of active devices which flash and move, and make detection of failed device 14 difficult if all devices 12, 14 are extinguished. The inventor has observed that approximately 20 seconds of arcing is sufficient to have second portions 76a and 76b release from ledges 80a and 80b. During this time, the arcing has been safely routed and occurs in fireproof enclosure 52. After the arcing period, arcing does not occur until after second end 66 is manually operated to return member 62 to the second position.

Additionally, it has been observed that only the relatively intense local heating of contact portion 74 causes wings 76a, 76b to release. Prolonged baking of mechanism 50 at elevated temperatures in excess of 400° F. did not release second portions 76a, 76b from ledge 80a, 80b.

Modification and variation can be made to the disclosed preferred embodiment without departing from the subject of the invention as defined in the following claims. Thus the reader is directed to the appended claims for the scope of the present invention which is not to be construed as being limited to the specific embodiment set out herein.

What is claimed is:

1. An apparatus for resetably shunting a failed electroluminescent tube in response to an electrical potential established by failure of said tube, said apparatus comprising:

a fireproof, dielectric enclosure having a closed interior and an exterior;

a first electrical contact electrically communicated to one terminal of said electroluminescent tube, said first electrical contact extending into the interior of said enclosure;

an actuating member interior of said enclosure mounted for movement towards and away from a position of electrical communication with said first electrical contact;

a second electrical contact electrically communicated through said enclosure to a second terminal of said electroluminescent tube;

means for biasing said actuating member towards said position of electrical communication with said first electrical contact;

a bimetallic latching member coupled to said actuating member, said bimetallic latching element having a first end attached to said actuating member proximate an end of said actuating member adjacent said first electrical contact, and a second end contacting said closed interior of said enclosure;

said enclosure defining at least one ledge for receiving and holding said second end of said bimetallic member;

said ledge positioned to maintain a separation of said actuating member from said first electrical contact at a preselected distance enabling the electrical potential to establish an arc across said separation whereby when said electroluminescent tube fails, said arc heats said bimetallic member to cause said member to release from said ledge permitting said actuating member to move responsive to said bias to shunt the circuit between said first and second terminals.

2. A process for automatically and resettably shunting a failed electroluminescent device in response to an electrical potential established by failure of said tube, said process comprising the steps of:

providing a shunting switch coupled in parallel to the device, said shunting switch comprising:

a fireproof, dielectric enclosure having a closed interior and an exterior;

a first electrical contact electrically communicated to one terminal of said electroluminescent tube, said first electrical contact extending into the interior of said enclosure;

an actuating member interior of said enclosure mounted for movement towards and away from a position of electrical communication with said first electrical contact;

a second electrical contact electrically communicated through said enclosure to a second terminal of said electroluminescent tube;

means for biasing said actuating member towards said position of electrical communication with said first electrical contact;

a bimetallic latching member coupled to said actuating member, said bimetallic latching element having a first end attached to said actuating member proximate an end of said actuating member adjacent said first electrical contact, and a second end contacting said closed interior of said enclosure;

said enclosure defining at least one ledge for receiving and holding said second end of said bimetallic member;

said ledge positioned to maintain a separation of said actuating member from said first electrical contact at a preselected distance enabling the electrical potential to establish an arc across said separation whereby when said electroluminescent tube fails, said arc heats said bimetallic member to cause said member to release from said ledge permitting said actuating member to move responsive to said bias to shunt the circuit between said first and second terminals;

moving said actuator member away from said first electrical contact and permitting said latch member to be held by said ledge;

locally heating said bimetallic member by arcing between said first electrical contact and said first end of said bimetallic member;

releasing said latch member due to bending of said bimetallic latch initiated by said localized heating of said bimetallic member;

shunting said failed device by contacting said bimetallic latch to said first electrical contact by permitting said actuating member to move to said position toward said first contact; and maintaining said shunt of said first device until said actuating member is manually reset to said second position.

* * * * *

UNITED STATES PATENT AND TRADEMARK OFFICE

CERTIFICATE OF CORRECTION

PATENT NO. : 4,947,147

DATED : August 7, 1990

INVENTOR(S) : Robert W. Minogue

It is certified that error appears in the above-identified patent and that said Letters Patent is hereby corrected as shown below:

In column 2, line 42, please delete "The. bimetallic" and insert therefor, --The bimetallic--;

In column 4, line 24, please delete "32" and insert therefor, --30--; and

In column 4, line 25, please delete "36" and insert therefor, --32--.

Signed and Sealed this

Thirty-first Day of December, 1991

*Attest:*

HARRY F. MANBECK, JR.

*Attesting Officer*

*Commissioner of Patents and Trademarks*